United States Patent [19]

Mitsuhashi

[11] Patent Number: 4,491,261

[45] Date of Patent: Jan. 1, 1985

[54] HAND-OPERATED STAPLER-PUNCH COMBINATION

[76] Inventor: Yoshio Mitsuhashi, 79, Higashi-Kibogaoka, Asahi-Ku, Yokohama-Shi, Kanagawa-ken, Japan

[21] Appl. No.: 338,791

[22] Filed: Jan. 11, 1982

[30] Foreign Application Priority Data

Jan. 20, 1981 [JP] Japan ..... 56-5930

[51] Int. Cl.[3] ..... B27F 7/00

[52] U.S. Cl. ..... 227/76; 7/160; 83/689

[58] Field of Search ..... 227/76, 120, 156; 7/160, 170; 292/251.5; 83/682, 689; 30/358, 363, 359

[56] References Cited

U.S. PATENT DOCUMENTS

| | | | |
|---|---|---|---|
| 2,950,140 | 8/1960 | Stone | 292/251.5 |
| 4,240,572 | 12/1980 | Mitsuhashi | 227/76 |
| 4,288,018 | 9/1981 | Taniguchi | 227/76 |

FOREIGN PATENT DOCUMENTS

| | | |
|---|---|---|
| 41-22884 | 11/1966 | Japan . |
| 48-43190 | 12/1973 | Japan . |
| 50-24460 | 8/1975 | Japan . |
| 53-71379 | 6/1978 | Japan . |

*Primary Examiner*—E. R. Kazenske
*Assistant Examiner*—Douglas D. Watts
*Attorney, Agent, or Firm*—Ladas & Parry

[57] ABSTRACT

A working combination of a stapler assembly (10) for fastening together sheets of paper or the like with U-shaped wire staples (S) one at a time and a punch assembly (12) capable of simultaneously perforating two holes. The stapler assembly is per se of conventional make including an elongate base (14) carrying a matrix (16) against which successive staples are forced out of a staple magazine (18) by a handle (20) having an ejector (22). The punch assembly comprises a platen (50) permanently or removably fastened to the stapler base, and a bed (54) hingedly coupled to the platen for relative pivotal motion about an axis extending longitudinally of the stapler base. A pair of perforating punches (52) are formed on either of the platen and the bed, and bores (58) for receiving the punches are formed in a die or dies (56) mounted to the other of the platen and the bed.

18 Claims, 12 Drawing Figures

HAND-OPERATED STAPLER-PUNCH COMBINATION

BACKGROUND OF THE INVENTION

This invention relates to operative combinations each of a hand stapler and a hand punch, and more particularly to such a stapler-punch combination with a capability of simultaneously perforating two or more holes, in addition to that of stapling in the usual manner.

I have proposed in my Japanese Pat. No. 809,831 (Publication No. 50-24460) and U.S. Pat. No. 3,907,190 a hand stapler combined with a punch mechanism which perforates a single hole at a time. My Japanese Utility Model Application No. 51-23164 (Laid-Open No. 52-128185) and Japanese Utility Model Publication No. 48-43190 suggest similar stapler-punch combinations, but with facilities for perforating two holes at a prescribed distance from each other. All these prior art devices are not entirely satisfactory, however, in demanding two punching operations for creating two holes.

Stapler-punch combinations capable of perforating two holes at a time have also been known, as disclosed for example in Japanese Utility Model Publication No. 41-22884. This known device is a mere aggregate of a conventional two-hole punch and staplers, with provisions for selective use of the device for either stapling, punching, or concurrent stapling and punching. Another example is my Japanese Patent Application No. 51-146716 (Laid-Open No. 53-71379). According to this prior application of mine a pair of hand staplers, each with a one-hole punch mechanism, are juxtaposed on a base. Also included is a mode selector mechanism for setting the device either in a stapling mode, for simultaneously fastening paper or the like with two staples, or in a punching mode for simultaneous perforation of two holes. Drawbacks common to both of these conventional devices are that they are bulky and complex in construction, difficult of manufacture, and expensive.

SUMMARY OF THE INVENTION

This invention overcomes the noted problems of the prior art and provides a simplified, compact, inexpensive device capable of both fastening paper or the like with one staple at a time and simultaneously perforating two or more holes.

Stated broadly, the stapler-punch combination in accordance with this invention comprises a base having an anvil or matrix adjacent one end, a staple magazine for receiving a bar of staples, and a handle having a staple ejector, all of which are the usual components of a hand stapler. The staple magazine and the handle are both coupled to the base for independent pivotal motion about a first axis adjacent the other end of the base. Upon depression of the handle the staple ejector forces a staple out of the magazine against the matrix on the base. The combination further includes a bed coupled to the base for pivotal motion about a second axis oriented at right angles with the first axis. A set of, normally two, perforating punches are formed on either of the base and the bed, and bores for receiving the punches are formed in the other of the base and the bed.

In some preferred embodiments of this invention a platen is secured to the stapler base, and the bed is jointed to this platen for pivotal motion about the second axis. The perforating punches are then formed on either of the platen and the bed, and the bores are formed in a die or dies mounted to the other. Thus the pivotal motion of the platen, together with the stapler mechanism mounted thereon, relative to the bed results in the creation of two holes at a time in the paper or the like placed between platen and bed. In one embodiment the stapler base and the punch platen are removably connected to each other, so that the stapler-punch combination is readily separable into the stapler assembly and the punch assembly.

The above and other features and advantages of this invention and the manner of attaining them will become more apparent, and the invention itself will best be understood, from a study of the following description of the preferred embodiments thereof illustrated in the attached drawings.

DESCRIPTION OF THE PREFERRED EMBODIMENTS

Figure 1:
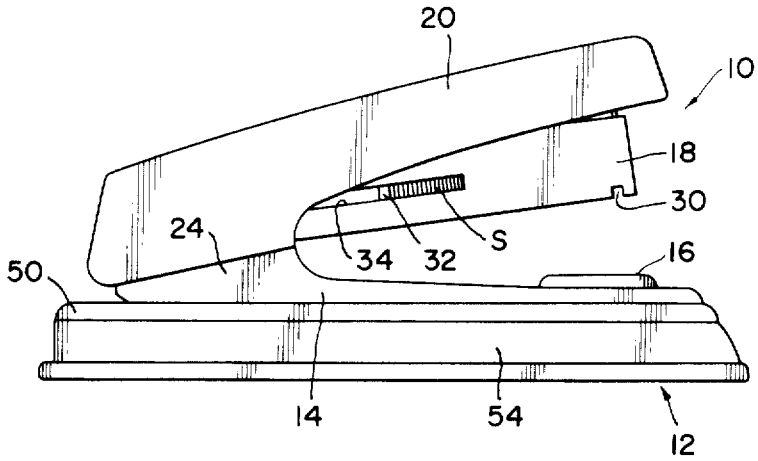
FIG. 1 is a side elevation of a preferred form of the stapler-punch combination embodying the principles of this invention.
Figure 2:
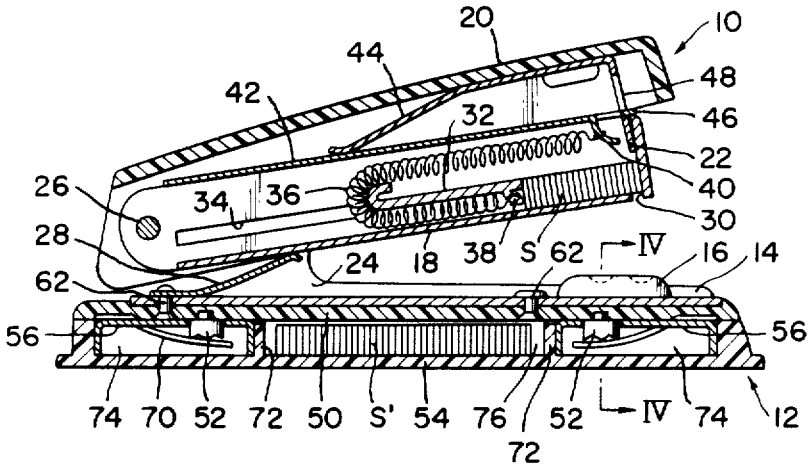
FIG. 2 is a vertical, longitudinal section through the stapler-punch combination of FIG. 1.

A first preferred embodiment of this invention will now be described with reference to FIGS. 1 through 5. With reference first and in particular to FIGS. 1 and 2 the stapler-punch combination shown in these drawings integrally comprises a hand stapler assembly 10 and a hand punch assembly 12. The stapler assembly 10 can itself be of any known or suitable design, so that the illustrated stapler assembly merely represents an example of numerous hand-operated staplers adoptable in the practice of this invention. The exemplified stapler assembly 10 broadly comprises:

1. an elongate base 14 having an anvil or matrix 16 at or adjacent its front end, shown directed to the right in FIGS. 1 and 2;

2. a staple magazine 18 for housing a bar of U-shaped wire staples S interconnected in a readily separable manner; and 3. a handle 20 carrying a staple ejector 22 for driving the successive staples S out of the staple magazine 18 against the matrix 16 on the base 14.

In the illustrated embodiment of this invention, the base 14 is formed integrally with a pair of upstanding lugs 24 at its rear end. The rear end portion of the staple magazine 18 is interposed between these lugs and pivotally coupled thereto via a pivot pin 26 oriented transversely of the base 14. A cantilever spring 28 on the base 14 biases the staple magazine 18 in a counterclockwise direction, as viewed in FIGS. 1 and 2, normally holding the front end portion of the magazine a preassigned distance away from the base.

Generally in the shape of an open-top box, the staple magazine 18 has an opening 30 at the front end of its bottom, from which the successive foremost ones of the staples S are forced out of the magazine. A pusher 32 is mounted in the staple magazine 18 for sliding motion in its longitudinal direction as guided by a pair of guide slots 34 in the opposite side walls of the magazine. The front end of the pusher 32 makes abutting engagement with the staple bar within the magazine. One of the ends of a helical tension spring 36 is hooked onto a retainer 38 at the front end of the pusher 32 and is folded over the rear end of the pusher, and its other end is hooked onto a retainer 40 at the front end of a cover 42 openably closing the top of the staple magazine 18. Thus the pusher 32 urges the bar of staples S forwardly under the bias of the stretch of the tension spring 36.

The handle 20 has the staple ejector 22 depending therefrom and normally projecting into the staple magazine 18 at its front end. The staple ejector 22 is integral with a cantilever spring 44 biasing the magazine top cover 42 away from the handle 20. Both the handle 20 and the cover 42 are pivotable independently about the pin 26. The cover 42 has a tongue 46 projecting forwardly from its front end and slidably engaged in a slot 48 in the staple ejector 22. Consequently, with its tongue 46 normally urged against the lower end of the slot 48 by the force of the cantilever spring 44, the cover 42 is pivotable relative to the cover 42 within the limits determined by the length of the slot. As the handle 20 together with the cover 42 is manually turned counterclockwise to a position approximately 180 degrees away from the staple magazine 18, the tension spring 36 becomes unfolded and straightened to pull the pusher 32 to its rearmost retracted position within the magazine. The subsequent turning of the handle 20 back to the illustrated position causes the tension spring 36 to move the pusher 32 forwardly of the staple magazine 18. The bar of staples S can therefore be loaded in the magazine by mere manipulation of the handle 20.

The hand stapler of this type is described and claimed in my aforesaid U.S. Pat. No. 3,907,190, dated Sept. 23, 1975, under the title of "Stapler with a Punch Mechanism".

Figure 3:
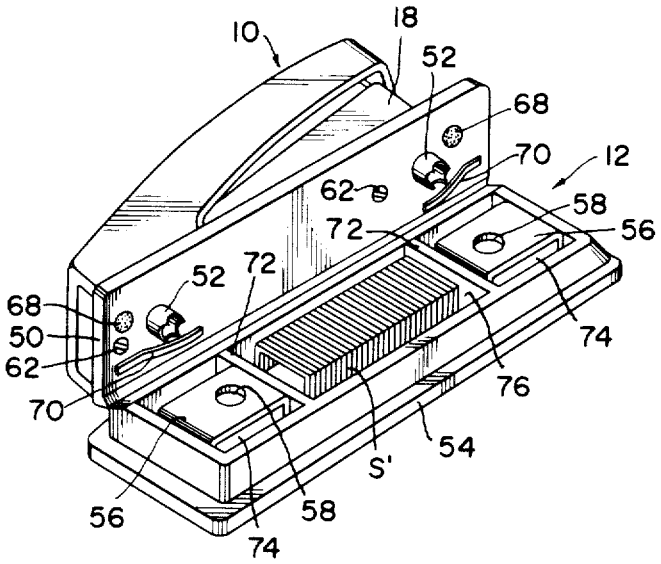
FIG. 3 is a perspective view of the stapler-punch combination of FIG. 1, shown with the platen turned away from the bed in the use of the punch assembly.
Figure 5:
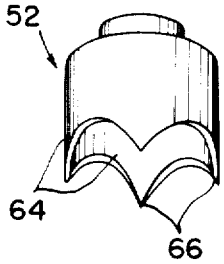
FIG. 5 is an enlarged perspective view of one of the two identical perforating punches in the stapler-punch combination of FIG. 1.

With reference directed also to FIG. 3 the punch assembly 12 broadly comprises:

1. a head or platen 50 secured to the base 14 of the stapler assembly 10 and having a pair of perforating punches 52 affixed thereto; and 2. a bed 54 hingedly coupled to the platen 50 and having mounted therein a pair of dies 56 defining bores 58 for receiving the perforating punches 52.

Figure 4:
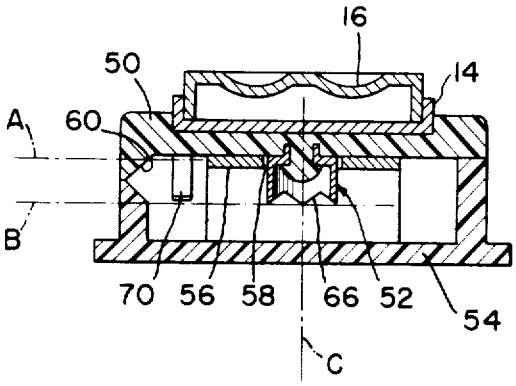
FIG. 4 is an enlarged section taken along the line IV—IV of FIG. 2.
Figure 6:
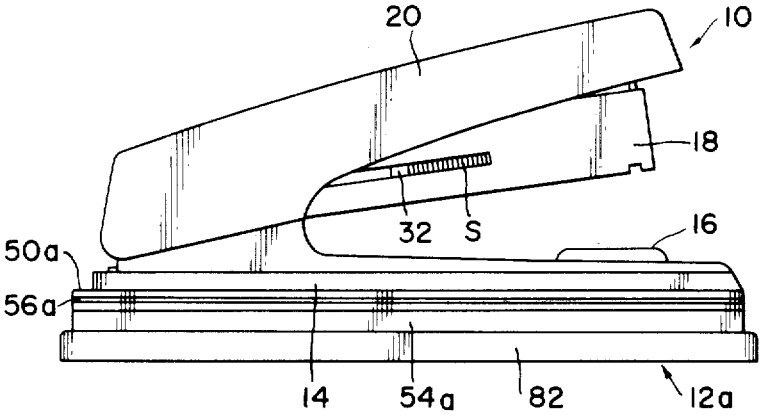
FIG. 6 is a side elevation of another preferred form of the stapler-punch combination in accordance with this invention.
Figure 7:
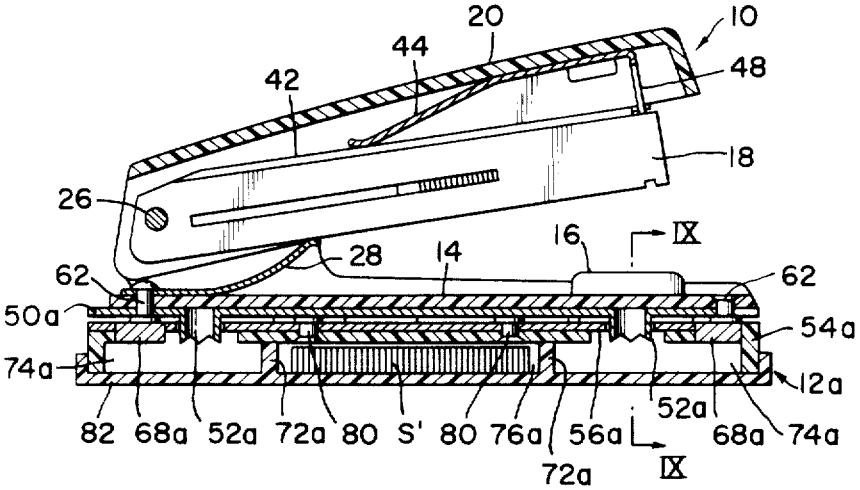
FIG. 7 is a vertical, longitudinal section through the stapler-punch combination of FIG. 6.
Figure 8:
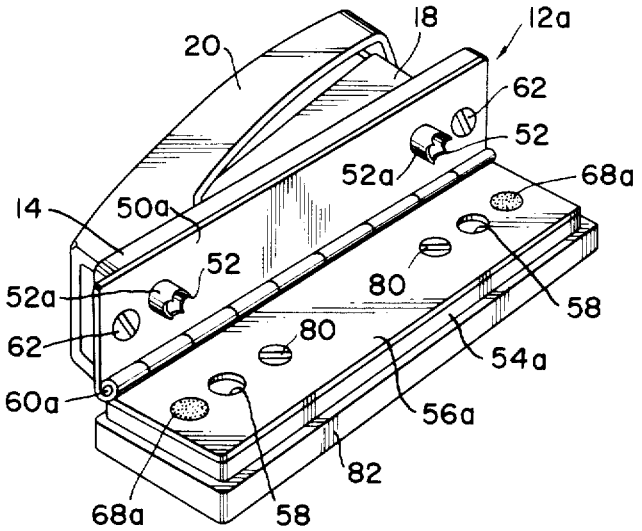
FIG. 8 is a perspective view of the stapler-punch combination of FIG. 6, shown with the platen turned away from the bed in the useof the punch assembly.
Figure 9:
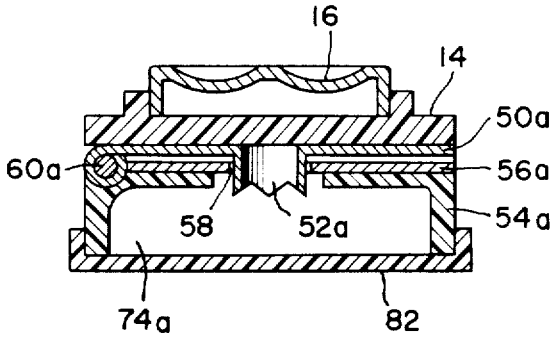
FIG. 9 is an enlarged section taken along the line IX—IX of FIG. 7.

In this particular embodiment of the invention, the platen 50 and the bed 54 are a unitary molding of plastics material. In order to allow pivotal motion of the platen 50 relative to the bed 54 about an axis extending longitudinally of the punch assembly (i.e., at right angles with the pivot pin 26 of the stapler assembly 10), a V-shaped groove 60 is formed internally at the boundary between platen and bed, as best illustrated in FIG. 4. The platen 50 is riveted or otherwise fastened to the stapler base 14 as at 62 in FIGS. 2 and 3. The pair of perforating punches 52 are spaced a prescribed distance from each other in the longitudinal direction of the platen 50. For the best results, as best pictured in FIG. 5, each perforating punch 52 has three or more, four in the illustrated example, cutting teeth 64 each having a pointed crest 66.

FIG. 3 also shows a permanent magnet 68 embedded in the platen 50, in the vicinity of each perforating punch 52, for attracting one of the dies 56 which are of sheet iron or like magnetic material. The permanent magnets 68 coact with the dies 56 to normally hold the platen 50 and the bed 54 closed against each other as in FIGS. 1 and 2. Seen at 70 is a stripper in the form of a cantilever spring, also disposed adjacent each perforating punch 52, for ready separation of perforated paper or the like from the punches.

The bed 54 is in the form of an open-top box, with two transverse partitions 72. Each in the shape of an inverted U, the dies 56 are mounted in spaces 74 bounded in the bed 54 by the partitions 72 on their outer sides, so that these spaces serve to accommodate punchings. Another space 76 between the partitions 72 is intended to hold in stock a spare bar or bars of staples S'.

For positively perforating thin or special-purpose paper or the like with the punch assembly 12 the perforating punches 52 should move into and out of the bores 58 in the dies 56 with minimal clearances. The attainment of this objective demands careful placement of the axis about which the punches 52 pivot in moving into and out of the die bores 56. Thus, as depicted in FIG. 4, the V-shaped groove 60 serving as the hinge joint between platen 50 and bed 54 is located between a plane A containing the entrance ends of the die bores 58 and a plane B containing the pointed crests 66 of the punches 52 fully received in the bores. These planes A and B are parallel to each other an normal to the axis C of each punch fully received in one of the die bores. This placement of the V-shaped groove 60 in accordance with an incidental feature of this invention makes it possible to reduce the clearances between punches and dies to a minimum and hence to remarkably enhance the perforating capability of the punch assembly.

In operation, for stapling together sheets of paper, for example, with the stapler-punch combination of the foregoing construction, the sheets are placed as usual between the base 14 and staple magazine 18 of the stapler assembly 10 in the state of FIGS. 1 and 2. Upon depression of the handle 20 as well as the staple magazine 18 against the forces of the cantilever springs 28 and 44, the ejector 22 forces the foremost one of the staples S out of the magazine. The ejected staple penetrates the sheets of paper and, clinched by the matrix 16, fastens them together.

For the use of the stapler-punch combination as a hand punch, the platen 50 of the punch assembly 12 is opened or turned away from the bed 54 to a position approximately 90 degrees away therefrom as in FIG. 3.

Then, with the paper or the like to be punched placed over the bed 54, or over the pair of dies 56 mounted therein, the platen 50 is pressed down to the position of FIGS. 1 and 2. The descending pair of punches 52 thereupon penetrate the paper as they enter the die bores 58. The platen 50 is again pivoted away from the bed 54 for withdrawal of the perforated paper. Although the paper will then tend to move with the punches 52 away from the bed 54, the pair of stripper springs 70 will act to release the paper from the punches, leaving the paper on the bed as the platen is turned away therefrom.

In FIGS. 6 through 9 a modified punch assembly 12*a* is combined with the stapler assembly 10 of the same construction as in the preceding embodiment of the invention to provide another preferred form of the stapler punch combination in accordance with this invention. The modified punch assembly 12*a* features a metal-made head or platen 50*a* formed integral with a pair of perforating punches 52*a*. The platen 50*a* is riveted at 62 to the base 14 of the stapler assembly 10 and hinged at 60*a* to a planar die 56*a* defining the bores 58. This die is riveted at 80 to a bed 54*a*, so that the platen is pivotable about the hinge 60*a* relative to the bed as in the foregoing embodiment. One or more, two in this embodiment, permanent magnets 68*a* are embedded in the die 56*a* to attract the platen 50*a* of magnetic material, for normally holding the platen closed against the die as in FIGS. 6, 7 and 9. The permanent magnet or magnets 68*a* could of course be attached to the platen 50*a*, provided that the die 56*a* is of a magnetic material.

Boxlike in shape, the bed 54*a* is partly open and has a removable bottom 82. This removable bottom is formed to include two transverse partitions 72*a* dividing the interior of the bed into two outer spaces 74*a* for containing punchings created by the punch assembly, and an intermediate space 76*a* for accommodating a spare bar or bars of staples Sa.

The other details of construction, as well as the manners of use of the stapler and punch assemblies, of this embodiment of the invention are substantially as set forth above in connection with FIGS. 1 through 5. An advantage of the second embodiment of the invention resides in the ease with which the perforating punches 52*a* are manufactured and mounted in place.

Figure 10:
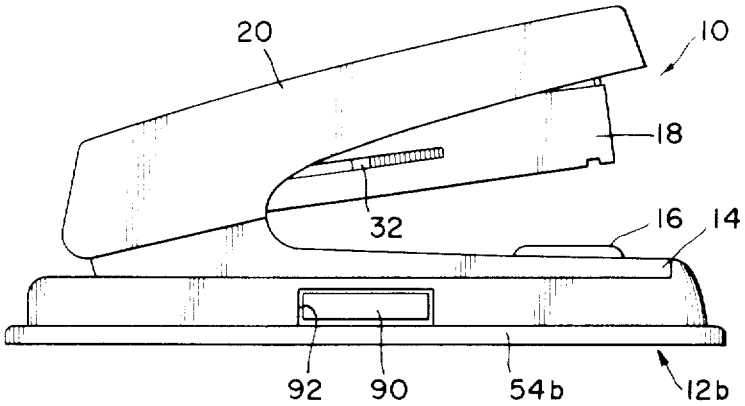
FIG. 10 is a side elevation of still another preferred form of the stapler-punch combination in accordance with this invention.
Figure 11:
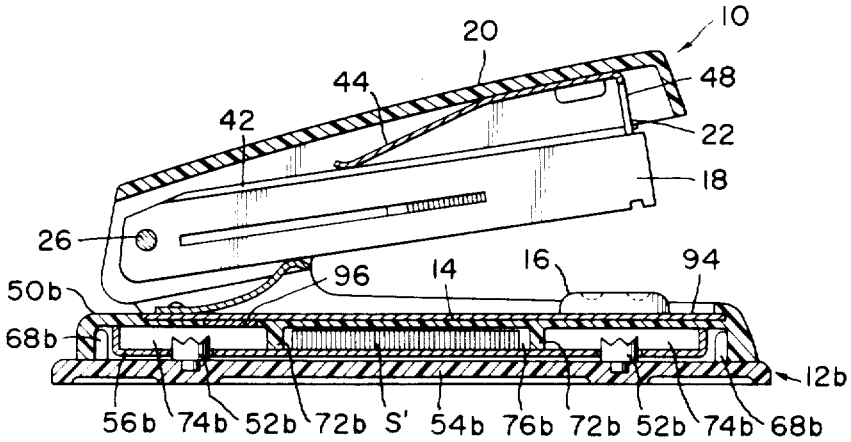
FIG. 11 is a vertical, longitudinal section through the stapler-punch combination of FIG. 10.
Figure 12:
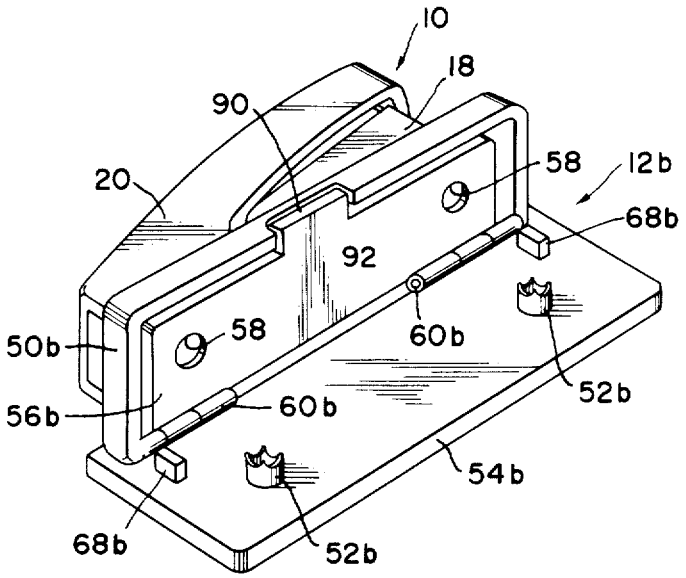
FIG. 12 is a perspective view of the stapler-punch combination of FIG. 10, shown with the platen turned away from the bed in the use of the punch assembly.

FIGS. 10 through 12 illustrate still another preferred embodiment of this invention, including another modified punch assembly 12*b* combined with the stapler assembly 10 of the first embodiment. In this punch assembly 12*b* a pair of perforating punches 52*b* are mounted on a flat bed 54*b*, instead of on the platen as in the two previous embodiments. The bed 54*b* is hinged at 60*b* to a platen 50*b* which in this embodiment of the invention takes the form of an open-bottom box. A die 56*b* defining the bores 58 for receiving the punches 52*b* is mounted in the platen 50*b* so as to close its bottom. The platen 50*b* is formed to include two transverse partitions 72*b* to define, in combination with the die 56*b*, two closed outer spaces 74*b* for accommodating punchings and a closed intermediate space 76*b* for receiving a spare bar or bars of staples Sa. The die 56*b* has an L-shaped lateral protuberance 90 at the midpoint of its longitudinal dimension. Exposed through a recess 92 in the platen 50*b*, this protuberance serves as a thumbpiece for parting the platen and the die from each other for withdrawing the punchings from the spaces 74*b* or for taking a spare staple bar Sa from the space 76*b*.

At 68*b* in FIGS. 11 and 12 are seen a pair of small projections 68*b* on the bed 54*b*. Instead of the permanent magnets used in the first two embodiments the projections 68*b* function to normally hold the platen 50*b* and the bed 54*b* closed against each other by internally and resiliently engaging the opposite end walls of the platen as in FIG. 11.

An additional feature of this third embodiment of the invention is that the stapler assembly 10 and the punch assembly 12*b* are made readily separable from each other to allow use of each as an independent unit. As shown in FIG. 11, the front end of the base 14 of the stapler assembly 10 is fitted in an undercut groove 94 in the platen 50*b* of the punch assembly 12*b* so as to be free to slide backward on the platen. A permanent magnet 96 is embedded in the platen 50*b* adjacent its rear end for attracting the stapler base 14 of magnetizable material. Normally, therefore, the stapler assembly is retained in position on the punch assembly 12*b* both by the attractive force of the magnet 96 and by the engagement of the front end of the stapler base in the undercut groove 94 in the punch platen 50*b*. By pulling the stapler base upwardly and backwardly of the punch platen, the device is readily separated into the stapler assembly and the punch assembly.

In the use of the stapler-punch combination of FIGS. 10 through 12, sheets of paper or the like are stapled by the stapler assembly 10 as combined with the punch assembly 12*b*, as has been explained with reference to FIGS. 1 and 2. Additionally, removed from the punch assembly, the stapler assembly may be grasped in one hand for stapling, as is usual with ordinary small-sized hand staplers.

For punching, paper or the like is placed over the perforating punches 52*b* of the punch assembly 12*b*, with its platen 50*b* pivoted away from the bed 54*b* as in FIG. 12. The paper is perforated as the platen is subsequently turned down onto the bed to receive the punches in the die bores 58. Thereafter, as the platen is again turned up, the perforated paper remains on the bed, ready for withdrawal from over the punches. The punch assembly 12*b* can likewise be removed from the stapler assembly 10 for punching. The separation of the punch assembly from the stapler assembly offers the advantage of permitting the use of both hands in depressing the platen onto the bed, as for punching thick paper or other not-easily-penetrable material.

Although the invention has been shown and described in terms of some preferred embodiments thereof, these are by way of example only and not intended to impose limitations upon the invention, since a variety of modifications or changes will readily occur to one skilled in the art on the basis of this disclosure. For example, the stapler-punch combination in accordance with this invention may incorporate a stapler assembly of various types other than the one represented here. Further, the platen could be omitted from the illustrated embodiments of the invention without in any way impeding the functions of the stapler-punch combination either as stapler or punch. In the absence of the platen, then, the perforating punches would be mounted directly to the stapler in the first two embodiments disclosed, and the bores for receiving the punches might be formed in the stapler base in the last embodiment. Thus, according to the broadest aspect of this invention, the set of perforating punches are to be formed on either of the base and the bed, and the bores for receiving the punches in the other of the base and the bed.

A further possible departure from the illustrated embodiments in the omission of the means (i.e., permanent magnets 68 or 68*a* or projections 68*b*) for normally holding the platen (or stapler base) and the bed closed against each other. The same purpose could be accomplished by closely fitting the perforating punches in the die bores.

It will also be seen that the three illustrated embodiments of the invention incorporate some interchangeable features. For instance, the stapler and punch assemblies could be made separable not only in the third but also in the first two embodiments. Another instance of interchangeable features is the hinge joint of different types between platen and bed adopted in the three embodiments.

What I claim is:

1. A hand-operated stapler-punch combination comprising:

(a) a base having an anvil adjacent one end;

(b) a staple magazine for receiving the bar of staples, the staple magazine being coupled to the base for pivotal motion about a first axis adjacent the other end of the base;

(c) a handle having a staple ejector for forcing the successive staples out of the staple magazine against the anvil on the base, the handle being coupled to the base and the staple magazine for pivotal motion about the first axis;

(d) a platen integral with the base;

(e) a bed coupled to the platen for pivotal motion about a second axis at right angles with the first axis and being in the form of an open-top box;

(f) a set of spaced-apart perforating punches formed on the platen; and (g) die means mounted in the beds and forming a set of bores for receiving the respective punches for cooperative punching operation.

2. The stapler-punch combination as recited in claim 1, wherein the bed (54) is partitioned (72) to provide spaces (74) for accommodating punchings.

3. The stapler-punch combination as recited in claim 2, wherein the bed (54) further provides a space (76) for housing a spare bare of staples (S').

4. The stapler-punch combination as recited in claim 1, wherein the dies (56) are of ferro magnetic material, and wherein the combination further comprises permanent magnets (68) attached to the platen (50) for attracting the dies in order to normally hold the platen and the bed (54) closed against each other.

5. The stapler-punch combination as recited in claim 1, further comprising stripper means (70) for separating perforated paper or the like from the perforating punches (52).

6. The stapler-punch combination as recited in claim 5, wherein the stripper means (70) comprises a cantilever spring attached to the platen (50) in the vicinity of each perforating punch (52).

7. The stapler-punch combination as recited in claim 1, wherein the bed (54*a*) has a removable bottom (82).

8. The stapler-punch combination as claimed in claim 1, wherein the platen is integral with the bed and a V-shaped groove is formed along the second axis to leave a thin connecting portion between the platen and the bed whereby the bed is pivotally connected to the platen along said connecting portion.

9. The stapler-punch combination as recited in claim 1, wherein the perforating punches are formed integrally with the platen.

10. The stapler-punch combination as recited in claim 1, wherein each perforating punch (52) has at least three cutting teeth (64) each with a pointed crest (66).

11. The stapler-punch combination as recited in claim 10, wherein the second axis lies between a plane (A) containing the entrance ends of the bores (58) and a plane (B) containing the pointed crests (66) of the perforating punches (52) fully received in the bores.

12. A hand-operated stapler-punch combination comprising:

(a) a base having an anvil adjacent one end;

(b) a staple magazine for receiving a bar of staples, the staple magazine being coupled to the base for pivotal motion about a first axis adjacent the other end of the base;

(c) a handle having a staple ejector for forcing the successive staples out of the staple magazine against the anvil on the base, the handle being coupled to the magazine against the staple magazine for pivotal motion about the first axis;

(d) a platen integral with the base and being in the form of an open-bottom box;

(e) a bed coupled to the platen for pivotal motion about a second axis at right angles with the first axis;

(f) a set of spaced-apart perforating punches formed on the bed; and (g) die means mounted in the platen and forming a set of bores for receiving the respective punches for cooperative punching operation.

13. The stapler-punch combination as recited in claim 12, wherein the platen (50*b*) is partitioned (72*b*) to provide, in combination with the die (56*b*), closed spaces (74*b*) for accommodating punchings.

14. The stapler-punch combination as recited in claim 13, wherein the platen (50*b*)further provides, in combination with the die (56*b*), a closed space (76*b*) for receiving a spare bar of staples (S').

15. The stapler-punch combination as recited in claim 12 wherein the platen (50*b*) is removable from the base (14) in order to separate the stapler-punch combination into a stapler assembly (10) and a punch assembly (12*b*).

16. A hand-operated stapler-punch combination comprising:

(a) a base having an anvil adjacent one end;

(b) a staple magazine for receiving a bar of staples, the staple magazine being coupled to the base for pivotal motion about a first axis adjacent the other end of the base:

(c) a handle having a staple ejector for forcing the successive staples out of the staple magazine against the anvil on the base, the handle being coupled to the base and the staple magazing for pivotal motion about the first axis;

(d) a bed coupled to the base for pivotal motion about a second axis at right angles with the first axis, said bed being in the form of an open-top box providing a space or spaces for accommodating punchings;

(e) a set of spaced-apart perforating punches fixed to the base;

(f) die means mounted on the bed to form a set of bores for receiving the respective punches for cooperative punching operation; and (g) holding means disposed between the base and the bed to normally hold them closed against each other while allowing openings thereof.

17. The stapler-punch combination as recited in claim 16 wherein said holding means are permanent magnets attached to the base for attracting the die means which is made of ferro magnetic material.

18. The stapler-punch combination as recited in claim 16 wherein said holding means are permanent magnets attached to the bed for attracting the base which is at least partially made of ferro magnetic material.

* * * * *